US009293243B2

(12) United States Patent
Kim et al.

(10) Patent No.: US 9,293,243 B2
(45) Date of Patent: Mar. 22, 2016

(54) ELECTROMAGNETIC DEVICE AND SWITCHING DEVICE USING SAME

(71) Applicants: Taehyun Kim, Chiyoda-ku (JP); Kyoichi Ohtsuka, Chiyoda-ku (JP); Tohru Kimura, Chiyoda-ku (JP); Kazuki Takahashi, Chiyoda-ku (JP)

(72) Inventors: Taehyun Kim, Chiyoda-ku (JP); Kyoichi Ohtsuka, Chiyoda-ku (JP); Tohru Kimura, Chiyoda-ku (JP); Kazuki Takahashi, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/380,750

(22) PCT Filed: Oct. 18, 2012

(86) PCT No.: PCT/JP2012/076936

§ 371 (c)(1),
(2) Date: Aug. 25, 2014

(87) PCT Pub. No.: WO2013/175653

PCT Pub. Date: Nov. 28, 2013

(65) Prior Publication Data

US 2015/0022297 A1 Jan. 22, 2015

(30) Foreign Application Priority Data

May 21, 2012 (JP) ..... 2012-115227

(51) Int. Cl.

| | |
|---|---|
| ***H01F 7/122*** | (2006.01) |
| ***H01F 7/16*** | (2006.01) |
| ***H01H 33/666*** | (2006.01) |
| ***H01H 3/28*** | (2006.01) |
| *H01H 33/38* | (2006.01) |

(52) U.S. Cl.

CPC ..... *H01F 7/122* (2013.01); *H01F 7/1615* (2013.01); *H01F 7/1623* (2013.01); *H01F 7/1646* (2013.01); *H01H 3/28* (2013.01); *H01H 33/6662* (2013.01); *H01H 33/38* (2013.01)

(58) Field of Classification Search

CPC ..... H01F 7/122; H01F 7/1615; H01F 7/1646; H01F 7/1623; H01H 33/6662

USPC ..... 335/179, 234

See application file for complete search history.

(56) References Cited

U.S. PATENT DOCUMENTS

2001/0017288 A1 8/2001 Morita et al.
2002/0093408 A1* 7/2002 Morita ..... H01F 7/1615 335/220

(Continued)

FOREIGN PATENT DOCUMENTS

JP 2001-237118 A 8/2001
JP 2011-216245 A 10/2011
WO WO 2011/052011 A1 5/2011

OTHER PUBLICATIONS

International Search Report (PCT/ISA/210) mailed on Jan. 22, 2013, by the Japanese Patent Office as the International Searching Authority for International Application No. PCT/JP2012/076936.

(Continued)

*Primary Examiner* — Ramon Barrera

(74) *Attorney, Agent, or Firm* — Buchanan Ingersoll & Rooney PC

(57) ABSTRACT

An electromagnetic device includes: a fixed iron core; a movable iron core which is disposed to face the fixed iron core and which is displaceable in an axis line direction of the drive shaft; an electromagnetic coil; a permanent magnet which retains the movable iron core at the advanced position; supporting posts which are provided parallel to the axis line direction on both side surfaces of the fixed iron core and support the fixed iron core; an opening-side plate which is provided at one end portion of the supporting post; and a closing-side plate which is provided at the other end portion of the supporting post, wherein the advanced position of the movable iron core is restricted by the fixed iron core and the retreated position is restricted by the opening-side plate.

4 Claims, 9 Drawing Sheets

(56) References Cited

U.S. PATENT DOCUMENTS

2012/0169441 A1 7/2012 Kim et al.
2012/0306601 A1 12/2012 Kim

OTHER PUBLICATIONS

European Search Report (PCT/JP2012076935) mailed Jan. 8, 2016 in corresponding International Patent Application No. 12877595.4 (8 pages).

* cited by examiner

ELECTROMAGNETIC DEVICE AND SWITCHING DEVICE USING SAME

TECHNICAL FIELD

The present invention relates to an electromagnetic device which is used for an operating mechanism of a switching device such as a breaker, for example, and a switching device using the electromagnetic device.

BACKGROUND ART

In a switching device using an electromagnetic device of the related art, for example, a movable contact of a breaking section of the switching device is connected to a movable iron core of an electromagnetic device composed of a fixed iron core and the movable iron core each configured by laminating a plurality of steel sheets, and the movable contact is driven and closed by an attraction force of the electromagnetic device. After the completion of the closing, a latch of a latch mechanism is hooked on a pin, whereby a closing state is maintained. At the time of breaking, an electromagnet for breaking is excited, thereby driving a plunger, and thus taking the latch of the latch mechanism off the pin. A movable shaft of the movable iron core of the electromagnetic device is mounted on a casing on which the electromagnetic device is mounted, through a bearing, in order to avoid the facing surfaces of the fixed iron core and the movable iron core being out of alignment at the time of an operation (refer to, for example, PTL 1).

Further, a technique to use a permanent magnet without using a latch mechanism as a mechanism of maintaining a closing state is also known (refer to, for example, PTL 2).

CITATION LIST

Patent Literature patent literature 1: JP-A-2001-237118 (Pages 5 and 6 and FIGS. 5 and 6)

patent literature 2: JP-A-2011-216245 (Pages 5 and 6 and FIGS. 1 and 2)

SUMMARY OF INVENTION

Technical Problem

In a switching device using the electromagnetic device as shown in PTL 1, after the completion of the closing, the latch of the latch mechanism is hooked on the pin, whereby the closing state is maintained, however, on the other hand, the braking is performed by taking the latch of the latch mechanism off the pin. In the latch mechanism performing such an operation, there is a problem in that periodic replacement is required due to wear of components and a time and a cost are required for maintenance.

Further, in the electromagnetic device in which there is no latch mechanism and a closing state is maintained by the attraction force of the permanent magnet, as in PTL 2, a bearing which supports a movable shaft of the movable iron core is mounted on a casing on which the electromagnetic device is mounted, and bearing support is performed at a single point. Therefore, it is difficult to control the tilting of the facing surfaces of the fixed iron core and the movable iron core, and at the time of the completion of the closing, there is a case where variation occurs in an attraction force for closing retention due to variation in the tilting of the fixed iron core and the movable iron core. In avoiding the aforementioned issue, a problem occurred in that the permanent magnet which maintains a closing retention state becomes increased in size.

The present invention has been made in order to solve the aforementioned problems and has an object to obtain an electromagnetic device in which, in an electromagnetic device to perform closing retention by a permanent magnet, variation in the attraction force of the permanent magnet can be reduced by suppressing occurrence of variation in the tilting of the facing surfaces of a movable iron core and a fixed iron core and assembling adjustment is easy, and a switching device using the electromagnetic device.

Solution to Problem

According to an aspect of the present invention, there is provided an electromagnetic device including: a fixed iron core; a movable iron core which is disposed to face the fixed iron core with a drive shaft fixed to a central portion and is displaceable in an axis line direction of the drive shaft between a retreated position away from the fixed iron core and an advanced position coming close to the fixed iron core; an electromagnetic coil provided in the fixed iron core; a permanent magnet which retains the movable iron core at the advanced position; a plurality of supporting posts which are provided parallel to the axis line direction on both side surfaces of the fixed iron core and support the fixed iron core; an opening-side plate which is provided at one end portion of the supporting post on the movable iron core side in a longitudinal direction and in which the drive shaft passes therethrough and is supported; and a closing-side plate which is provided at the other end portion of the supporting post in the longitudinal direction and in which the drive shaft passes therethrough and is supported, wherein the advanced position of the movable iron core is restricted by the fixed iron core, and the retreated position is restricted by the opening-side plate.

According to another aspect of the present invention, there is provided a switching device including: a switch main body section having a fixed contact and a movable contact capable of coming into contact with and being separated from the fixed contact; an electromagnetic device which is connected to the movable contact of the switch main body section through a connecting device and makes the movable contact come into contact with and be separated from the fixed contact; and a biasing body which biases a movable iron core of the electromagnetic device in a direction in which the movable contact is separated from the fixed contact, wherein as the electromagnetic device, the electromagnetic device described above is used.

Advantageous Effects of Invention

According to the electromagnetic device related to the present invention, the electromagnetic device has the plurality of supporting posts which are provided parallel to the axis line direction on both side surfaces of the fixed iron core and support the fixed iron core, the opening-side plate which is provided at one end portion of the supporting post on the movable iron core side in the longitudinal direction and in which the drive shaft passes therethrough and is supported, and the closing-side plate which is provided at the other end portion of the supporting post in the longitudinal direction and in which the drive shaft passes therethrough and is supported, and is configured such that the advanced position of the movable iron core is restricted by the fixed iron core and the retreated position is restricted by the opening-side plate, and therefore, the drive shaft of the movable iron core supported by both plates is reliably restricted by the closing-side plate and the opening-side plate, and it is possible to prevent tilting occurring between the fixed iron core and the movable iron core, and therefore, occurrence of a gap between the fixed iron core and the movable iron core, which occurs when the movable iron core is at the advanced position, can be prevented. Therefore, since a retention force generated by the permanent magnet is stable, it becomes possible to reduce the volumes of the permanent magnet, the fixed iron core, and the movable iron core, which are required in order to generate a predetermined retention force, and thus, it is possible to attain a reduction in size and a reduction in cost of the electromagnetic device.

Further, according to the switching device related to the present invention, as the electromagnetic device which drives the movable contact of the switch main body section, the electromagnetic device described above is used, and therefore, occurrence of variation in tilting of the facing surfaces of the movable iron core and the fixed iron core of the electromagnetic device is suppressed, whereby variation in the attraction force of the permanent magnet can be reduced. Therefore, variation in switching operation is suppressed, and thus, it is possible to obtain a switching device having excellent operating characteristics.

BRIEF DESCRIPTION OF DRAWINGS

FIG. 1 is a cross-sectional front view showing an opening state of a switching device which uses an electromagnetic device according to Embodiment 1 of the present invention.

FIG. 2 is a cross-sectional front view showing a closing state of the switching device of FIG. 1.

FIG. 3 is a front view of the electromagnetic device according to Embodiment 1.

FIG. 4 is a side view of the electromagnetic device of FIG. 3.

[FIG. 5]

FIG. 6 is a side view showing an assembled state of FIG. 5.

FIG. 7 is a front view showing another example of the electromagnetic device according to Embodiment 1 of the present invention.

FIG. 8 is a perspective view showing a main section of FIG. 7.

FIG. 9 is a cross-sectional front view of an electromagnetic device according to Embodiment 2 of the present invention.

FIG. 10 is a side view of FIG. 9.

FIG. 11 is a perspective view showing a main section of FIG. 9.

[FIG. 12]

FIG. 13 is a side view of an electromagnetic device according to Embodiment 3 of the present invention.

FIG. 14 is a side view showing another example of the electromagnetic device according to Embodiment 3.

FIG. 15 is a front view showing still another example of the electromagnetic device according to Embodiment 3.

FIG. 16 is a front view showing still another example of the electromagnetic device according to Embodiment 3.

DESCRIPTION OF EMBODIMENTS

Embodiment 1

Figure 1:
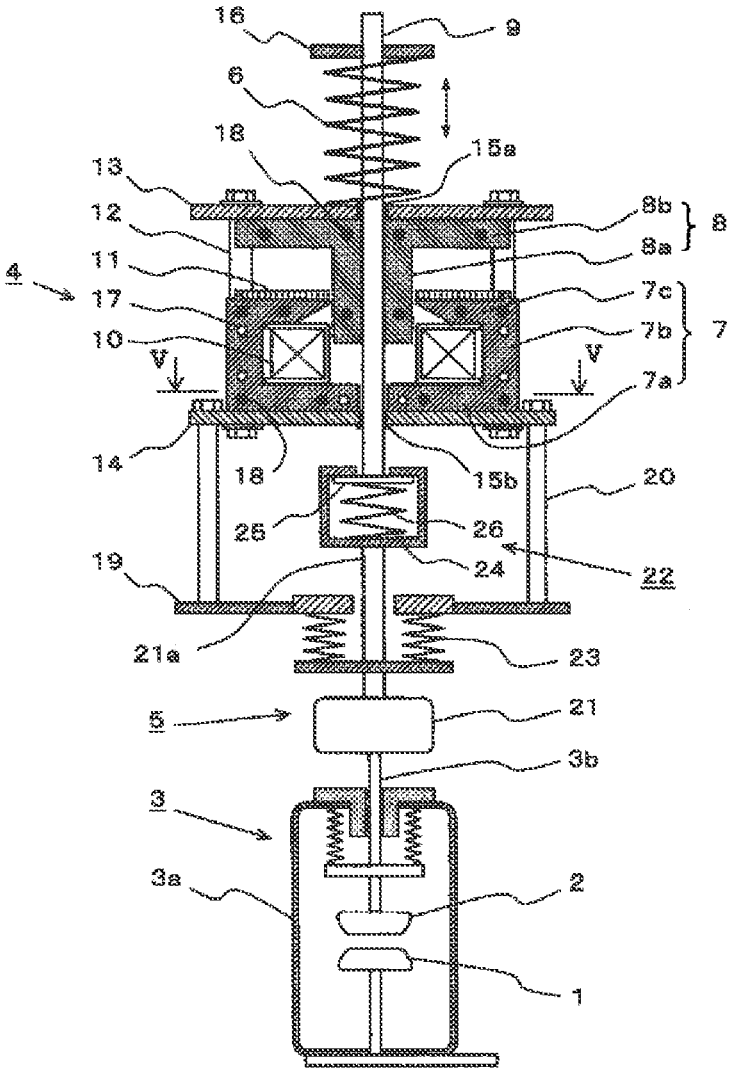
[FIG. 1]
Figure 2:
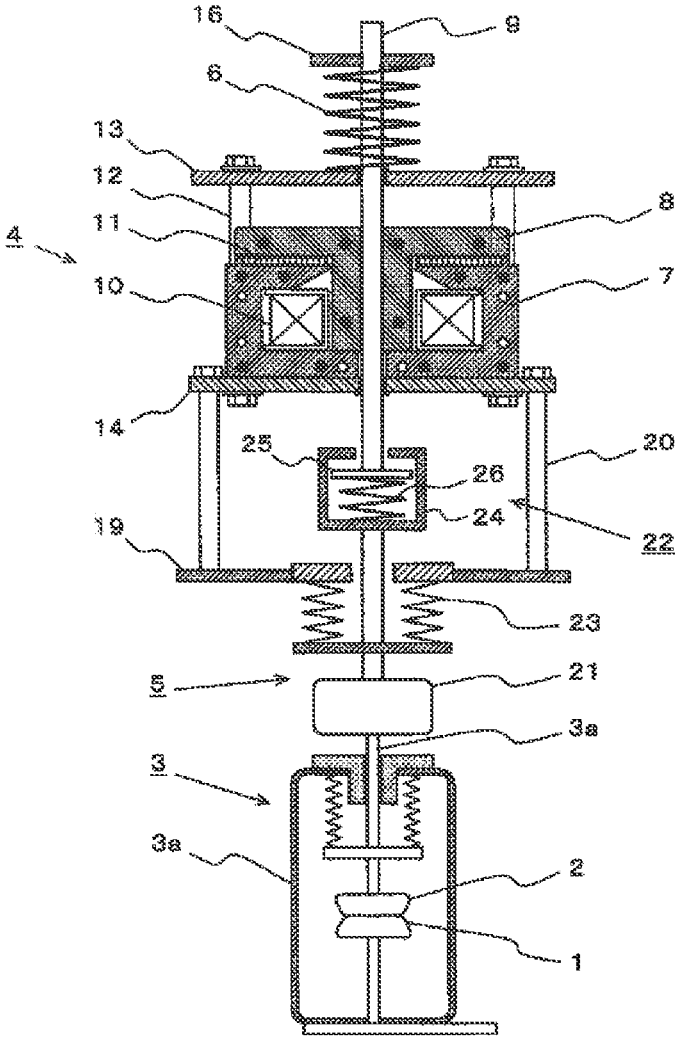
[FIG. 2]
Figure 3:
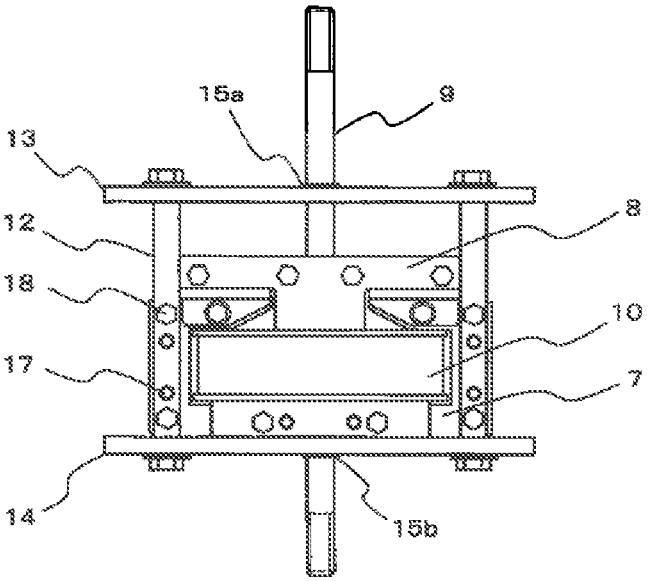
[FIG. 3]
Figure 4:
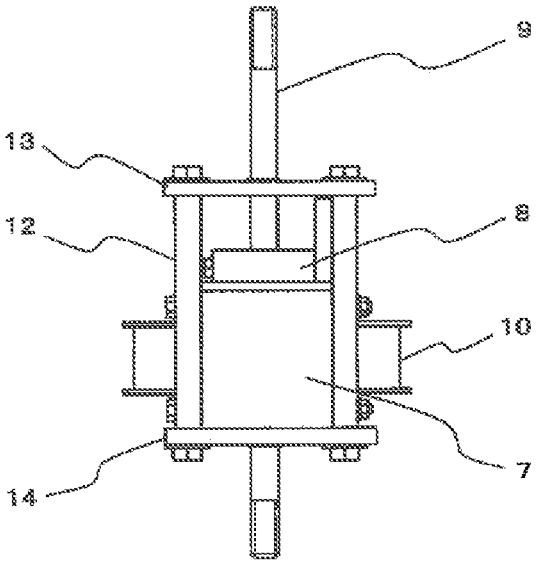
[FIG. 4]

FIG. 1 is a cross-sectional front view showing a switching device which uses an electromagnetic device according to Embodiment 1 of the present invention and shows an opening state where a contact of a switch is open, and FIG. 2 is a cross-sectional front view showing a closing state where the contact of the switch of the switching device of FIG. 1 is closed. Further, FIG. 3 is a front view of an electromagnetic device section, and FIG. 4 is a side view thereof. In addition, as a switch main body section, a vacuum circuit breaker using a vacuum valve is described as an example. However, the present invention is not limited thereto and can also be applied to a disconnecting switch, a grounding switch, or the like.

First, the overall configuration of the switching device which uses the electromagnetic device will be described with reference to FIGS. 1 and 2.

The switching device has a vacuum valve 3 having a fixed contact 1 and a movable contact 2, an electromagnetic device 4 which displaces the movable contact 2 of the vacuum valve 3 in a direction toward or away from the fixed contact 1, a connecting device 5 which connects the vacuum valve 3 and the electromagnetic device 4, and an opening spring 6 that is a biasing body which biases the movable contact 2 in a direction in which the movable contact 2 is separated from the fixed contact 1.

In the vacuum valve 3, the fixed contact 1 and the movable contact 2 are accommodated in an insulation container 3*a*, and one end of a movable electrode rod 3*b* fixed to the movable contact 2 is led out from the insulation container 3*a* to the outside and connected to the movable side of the electromagnetic device 4 through the connecting device 5. In this way, the movable contact 2 is displaced by moving in an axis line direction of the vacuum valve 3. The movable contact 2 comes into contact with the fixed contact 1, whereby a closing state is created, and the movable contact 2 is separated from the fixed contact 1, whereby an opening state is created. The inside of the vacuum valve 3 is maintained under vacuum in order to improve arc-extinguishing capability between both the contacts 1 and 2.

The electromagnetic device 4 has a fixed iron core 7, a movable iron core 8 disposed to face the fixed iron core 7, a drive shaft 9 provided to pass through a central portion of the movable iron core 8 and fixed to the movable iron core 8, an electromagnetic coil 10 which is provided in the fixed iron core 7 and generates a magnetic field by energization, a permanent magnet 11 provided on the fixed iron core 7 side, a supporting post 12 fixing the fixed iron core 7, and an opening-side plate 13 and a closing-side plate 14 respectively disposed at both ends of the supporting post 12. The movable iron core 8 is made so as to be able to be displaced by being driven in an axis line direction (a thick arrow direction in FIG. 1, hereinafter referred to simply as an axis line direction) of the drive shaft 9 with respect to the fixed iron core 7.

In addition, bearings 15*a* and 15*b* for the drive shaft 9 are respectively fixed to portions where the drive shaft 9 passes through the opening-side plate 13 and the closing-side plate 14.

Further, a spring bearer 16 is fixed to the leading end side of the drive shaft 9 protruding further to the outside than the opening-side plate 13, and the opening spring 6 (the biasing body) described previously is inserted on a shaft portion of the drive shaft 9 between the opening-side plate 13 and the spring bearer 16. The opening spring 6 is, for example, a compressed coil spring and generates an elastic repulsive force in the axis line direction between the opening-side plate 13 and the spring bearer 16.

The configuration of the electromagnetic device 4 will be described in more detail with reference to FIGS. 3 and 4 as well.

The fixed iron core 7 and the movable iron core 8 are configured by laminating thin plates. As shown in FIG. 1, the fixed iron core 7 is shaped to have a transverse iron core portion 7*a* extending in a direction orthogonal to the axis line direction, longitudinal iron core portions 7*b* extending in the axis line direction from both end portions of the transverse iron core portion 7*a*, and permanent magnet fixing portions 7*c* extending toward the axis line from the longitudinal iron core portions 7*b*, and an opening hole 7*d* through which the drive shaft 9 can pass to have a gap therebetween is formed at the center of the transverse iron core portion 7*a* (refer to FIG. 5).

The longitudinal iron core portion 7*b* of the fixed iron core 7 is tightened and fixed to the supporting posts 12 to be sandwiched between the supporting posts 12 from both sides of the plate surface thereof, that is, both surfaces in a lamination layer direction. Although the details will be described later, a pin hole positioned to the supporting post 12 with a high degree of accuracy is machined in the longitudinal iron core portion 7*b*, and thus the longitudinal iron core portion 7*b* is fixed by a pin 17, and furthermore, bolts 18 are inserted into a plurality of bolt holes drilled in the lamination layer direction and fastened by nuts (not shown), whereby the longitudinal iron core portion 7*b* is integrated with the supporting post 12.

On the other hand, the movable iron core 8 has a mainstay portion 8*a* disposed along the axis line direction, and a pair of branch portions 8*b* protruding in the opposite directions to each other toward a direction orthogonal to the axis line direction from the side surfaces of the mainstay portion 8*a*. The movable iron core 8 is also integrated with the drive shaft 9 inserted into the central portion by being fastened using a plurality of bolts 18 drilled in the lamination layer direction and nuts (not shown) screwed onto the respective bolts 18. Then, the movable iron core 8 is made so as to be displaceable between a retreated position (refer to FIG. 1) where the movable iron core 8 is separated from the fixed iron core 7 and comes into contact with the opening-side plate 13, and an advanced position (refer to FIG. 2) where the movable iron core 8 comes into contact with the fixed iron core 7.

In addition, as a material of the fixed iron core 7 and the movable iron core 8, it is favorable if the material is a magnetic material having high permeability, and for example, a steel material, electromagnetic soft iron, silicon steel, ferrite, permalloy, and the like can be given.

Further, as a material of the drive shaft 9, a material having low permeability (a low-magnetic material), for example, stainless steel or the like can be used.

The permanent magnet 11 is disposed on the permanent magnet fixing portions 7*c* of the fixed iron core 7 so as to face the surfaces on the closing side of the branch portions 8*b* of the movable iron core 8, as shown in FIG. 1. Then, the permanent magnet 11 has an N pole and an S pole (a pair of magnetic poles), wherein the magnetic pole on one side faces the permanent magnet fixing portions 7*c* and the magnetic pole on the other side faces the closing sides of the branch portions 8*b* of the movable iron core 8. The permanent magnet 11 is for generating magnetic flux for retention which retains the movable iron core 8 at the advanced position. In addition, it is favorable if the fixing of the permanent magnet 11 is performed, for example, by covering the permanent magnet 11 with a mounting member (not shown) bent and formed into a U-shape, from the upper surface of the permanent magnet 11, and fastening and fixing the mounting member by bolts in the lamination layer direction of the permanent magnet fixing portion 7*c*.

Further, the electromagnetic coil 10 is disposed so as to pass through between the mainstay portion 8*a* of the movable iron core 8 and the longitudinal iron core portions 7*b* of the fixed iron core 7. In an example of this embodiment, the electromagnetic coil 10 surrounds the mainstay portion 8*a* in a projection plane in the axis line direction. In this way, if the electromagnetic coil 10 is energized, the electromagnetic coil 10 generates magnetic flux passing through the fixed iron core 7 and the movable iron core 8. Further, a direction of the magnetic flux which is generated by the electromagnetic coil 10 is made so as to be reversible with the switching of an energization direction to the electromagnetic coil 10.

Next, a connection section between the electromagnetic device 4 and the vacuum valve 3 will be described with reference to FIG. 1.

The electromagnetic device 4 is supported on a plate-shaped supporting member 19 through mounting posts 20. Usually, the vacuum valve 3 is accommodated in a container (not shown) in which insulating gas (for example, SF6 gas, dry air, or the like) for securing the dielectric strength voltage of a peripheral portion is contained. For this reason, the supporting member 19 described above is, for example, a lid body of the container, and the mounting posts 20 are provided to be erect on the supporting member 19 made of the lid body, and the closing-side plate 14 of the electromagnetic device 4 is then fixed to the mounting posts 20 by bolting or the like. However, the supporting member 19 is not limited thereto and may be a supporting plate of, for example, a switchboard.

The connecting device 5 which connects the movable electrode rod 3*b* fixed to the movable contact 2 of the vacuum valve 3 and the drive shaft 9 of the electromagnetic device 4 has an insulating rod 21 connected to the movable electrode rod 3*b*, a connecting rod 21*a* connected to the insulating rod 21, a pressure-contacting device 22 interposed between the connecting rod 21*a* and the drive shaft 9, and a bellows 23 provided to connect the connecting rod 21*a* and the supporting member 19 such that the connecting rod 21*a* can move with respect to the supporting member 19 which is a portion of a gas container while maintaining airtightness at a portion where the connecting rod 21*a* passes through the supporting member 19. In addition, according to the configuration of the supporting member 19, there is also a case where the bellows 23 is unnecessary.

The pressure-contacting device 22 has a spring frame 24 fixed to an end portion of the connecting rod 21*a*, fall-off preventing plate 25 fixed to a leading end portion of the drive shaft 9 and disposed in the spring frame 24, and a pressure-contacting spring 26 inserted in a compressed state between the spring frame 24 and the fall-off preventing plate 25. The pressure-contacting spring 26 biases the drive shaft 9 in a direction away from the insulating rod 21. The drive shaft 9 is made so as to be displaceable in the axis line direction together with the fall-off preventing plate 25, and the displacement is restricted by the engagement of the fall-off preventing plate 25 with the spring frame 24.

In addition, in FIGS. 1 and 2, a case where the axis line of the electromagnetic device 4 and the axis line of the vacuum valve are aligned in a straight line is shown. However, a configuration is also acceptable in which a direction is converted by interposing a lever or the like in the connecting device 5 section.

The invention of this application has a feature in a support configuration between the fixed iron core 7 and the movable iron core 8 sections, and therefore, the configuration of the portions will be described in more detail.

The longitudinal iron core portion 7*b* of the fixed iron core 7 is tightened and fixed to the supporting posts 12 to be sandwiched between the supporting posts 12 from both surfaces thereof, as described previously. In the fixing, the pin holes positioned with a high degree of accuracy are machined in the longitudinal iron core portion 7*b* and the supporting post 12, and the longitudinal iron core portion 7*b* and the supporting post 12 are fixed to each other by the pin 17, whereby the positional relationship between the fixed iron core 7 and the supporting post 12 is maintained with a high degree of accuracy. Furthermore, the bolts 18 are inserted into the plurality of bolt holes drilled in the lamination layer direction and fastened by nuts (not shown).

Figure 5A:
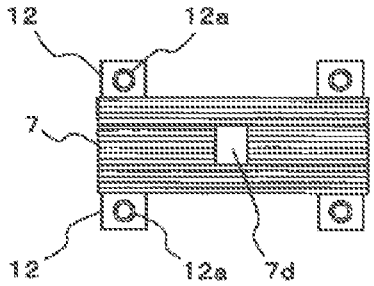
FIGS. 5A, 5B, 5C are an explanatory diagram describing the relationship between fixed iron core, supporting post, and closing-side plate sections of the electromagnetic device according to Embodiment 1.
Figure 5B:
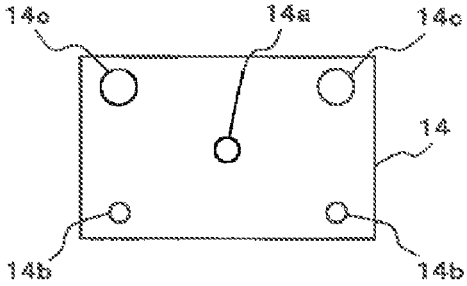
Figure 5C:
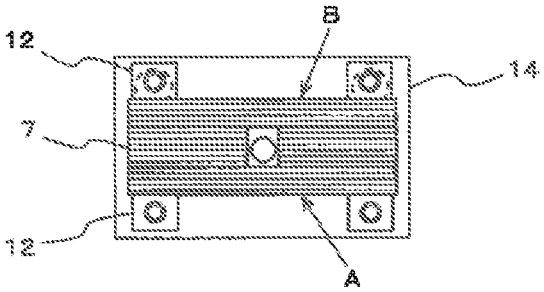

Here, the assembling in the lamination layer direction of the fixed iron core will be described using FIGS. 5 and 6. FIG. 5A is a cross-sectional view when a state where the fixed iron core 7 and the supporting posts 12 are combined with each other in the electromagnetic device 4 is viewed from V-V of FIG. 1, and FIG. 5B is a plan view of the closing-side plate 14 which is combined with FIG. 5A. Further, FIG. 5C is a cross-sectional plan view when a state where FIG. 5A and FIG. 5B are combined with each other is viewed from V-V. In any drawing, the bolt and the like are not shown.

In FIG. 5A, threaded holes 12*a* for the mounting of the closing-side plate 14 and the opening-side plate 13 are machined in both end portions of the supporting post 12 in a longitudinal direction. Further, the opening hole 7*d* through which the drive shaft 9 movably passes is formed in the fixed iron core 7, as described previously.

On the other hand, as shown in FIG. 5B, in the closing-side plate 14, a bearing mounting hole 14*a* in which the bearing 15*b* for the drive shaft 9 is mounted is formed at a central portion, and a plurality of supporting post mounting holes (in this embodiment, there are four) for mounting the supporting posts 12 are formed in a peripheral portion.

Among the supporting post mounting holes, a supporting post mounting hole 14*b* for the supporting post 12 which is mounted on the surface on one side of the fixed iron core 7 in the lamination layer direction is formed to be machined with a high degree of accuracy so as to be positioned in a predetermined dimension on the basis of the bearing mounting hole 14*a*. In contrast, a supporting post mounting hole 14*c* for the supporting post 12 which is mounted on the surface on the other side is formed to have a size in which the supporting post 12 can be mounted even if a mounting position is varied within a dimensional tolerance of the thickness of the fixed iron core 7 in the lamination layer direction.

In addition, the relationship between the opening-side plate 13 and the supporting post 12 also has the same configuration.

Therefore, in a state of being combined as in FIG. 5C, the fixed iron core 7 and the supporting posts 12 are assembled to each other with the supporting posts 12 on a side of the surface (a surface A in the drawing) on one side of the fixed iron core 7 in the lamination layer direction accurately positioned by the supporting post mounting holes 14*b* of the closing-side plate 14 shown in FIG. 5B. Further, as for the supporting posts 12 on a side of the surface (a surface B in the drawing) on the other side in the lamination layer direction, the supporting post mounting hole 14*c* is machined to a size with a margin in consideration of a dimensional tolerance in the lamination layer direction of the thin plate of the fixed iron core 7. As such, even if there is variation present in the thickness in the lamination layer direction, as long as it is within the dimensional tolerance, fixing can be directly performed.

In this way, even in a case where the dimensions of the fixed iron core 7 and the movable iron core 8 are changed due to variation in the plate thickness of the thin plate in the lamination layer direction at the time of the assembling, the assembling is performed accurately.

Further, since the bearing mounting hole 14*a* and the supporting post mounting hole 14*b* are also machined with a predetermined degree of accuracy, the bearings 15*a* and 15*b* are assembled to the fixed iron core 7 with a relationship of being positioned with a high degree of accuracy.

Since the opening hole 7*d* of the fixed iron core 7 is opened to have a size with a margin with respect to the bearing mounting hole 14*a* of the closing-side plate 14, the drive shaft 9 does not interfere with the opening hole 7*d*.

In addition, in the supporting post 12, the worked surfaces and the threaded holes 12*a* of both ends and the positions of the pin hole and the bolt hole in the side surface can be worked with a high degree of accuracy by machining, and therefore, the opening-side plate 13 and the closing-side plate 14 can be accurately disposed at both ends of the supporting post 12.

Figure 6:
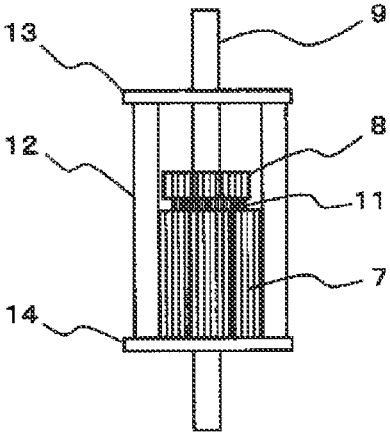
[FIG. 6]

FIG. 6 is a side view in a state where the fixed iron core 7, the movable iron core 8, and the permanent magnet 11 are assembled to be combined with the opening-side plate 13, the closing-side plate 14, and the supporting posts 12. Illustration of the bolt and the like is omitted.

As shown in the drawing, even in a case where the centers of the fixed iron core 7 and the movable iron core 8 are not aligned each other in the lamination layer direction, if the misalignment is within a predetermined tolerance, it is possible to accurately assemble the electromagnetic device, as described above.

Here, the width dimensions of the fixed iron core 7 and the movable iron core 8 in the lamination layer direction are made larger than the width of the permanent magnet 11 viewed in the same direction. Then, the width dimensions in the lamination layer direction are large in the order of the fixed iron core 7, the movable iron core 8, and the permanent magnet 11.

In this way, even in a case where position shifts in the lamination layer direction occur between the permanent magnet 11, the fixed iron core 7, and the movable iron core 8, each of the surface on the fixed iron core 7 side of the permanent magnet 11 and the surface on the movable iron core 8 side of the permanent magnet 11 is made so as to be able to face over the entire surface, as shown in FIG. 6, and thus magnetic flux generated by the permanent magnet 11 is made so as to be able to efficiently pass through the fixed iron core 7 and the movable iron core 8.

Next, an operation of the switching device will be described. When being in an opening state where the movable contact 2 is separated from the fixed contact 1, as shown in FIG. 1, the movable iron core 8 is at the retreated position due to the biasing force of the opening spring 6. If the electromagnetic coil 10 is energized, the movable iron core 8 is attracted to the fixed iron core 7 and displaced toward the advanced position from the retreated position against the load of the opening spring 6. In this way, the movable contact 2 moves toward the fixed contact 1.

Thereafter, if the movable contact 2 comes into contact with the fixed contact 1, the movement of the movable contact 2 is stopped. However, the movable iron core 8 is further displaced, which makes the mainstay portion 8*a* come into contact with the transverse iron core portion 7*a* of the fixed iron core 7, thereby reaching the advanced position. In this way, the pressure-contacting spring 26 is shrunk and the movable contact 2 is pressed against the fixed contact 1 with a predetermined pressing force, and thus a closing operation is completed and a state as shown in FIG. 2 is created.

If the movable iron core 8 reaches the advanced position, the movable iron core 8 is attracted and retained by the magnetic flux for retention of the permanent magnet 11, and thus the advanced position is retained.

When releasing the retention of the movable iron core from the advanced position, energization to the electromagnetic coil 10 is performed in the opposite direction to that at the time of the closing operation. In this way, an attraction force between the movable iron core 8 and the fixed iron core 7 is reduced and the movable iron core 8 is moved to the retreated position by the respective loads of the opening spring 6 and the pressure-contacting spring 26. At an early stage of the displacement, the movable contact 2 remains pressed against the fixed contact 1.

Thereafter, if the displacement of the movable iron core toward the retreated position proceeds, the fall-off preventing plate 25 is engaged with the spring frame 24. In this way, the movable contact 2 is displaced in a direction away from the fixed contact 1. If the movable iron core 8 is further displaced, thereby coming into close contact with the opening-side plate 13, and thus reaching the retreated position, an opening operation is completed and a state of FIG. 1 is created.

Figure 7:
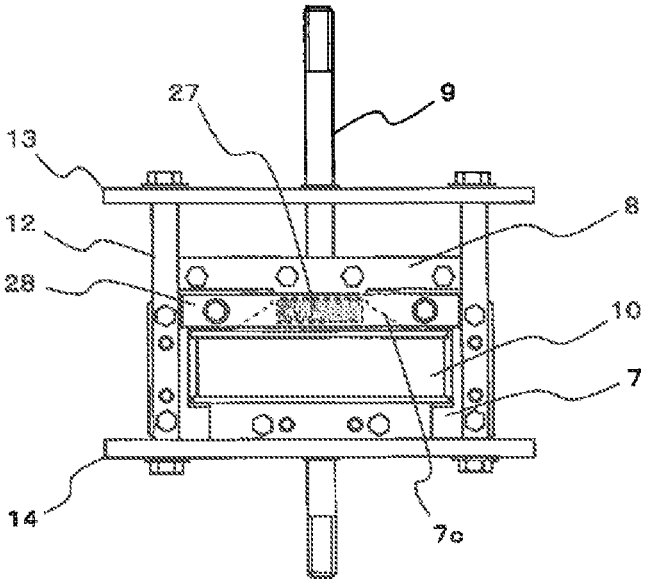
[FIG. 7]
Figure 8:
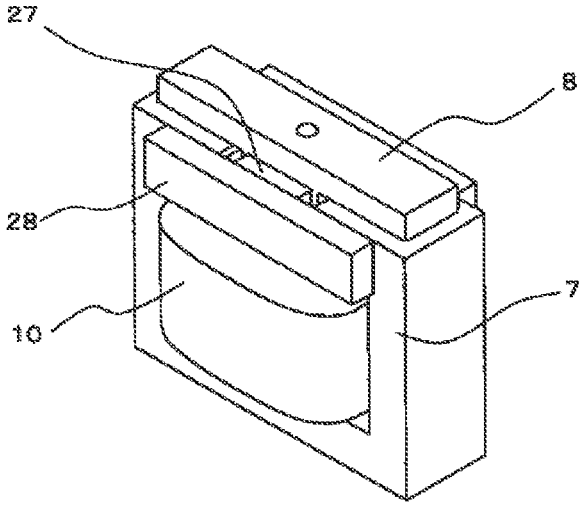
[FIG. 8]

In addition, the shape and the mounting of the permanent magnet may have configurations as in FIGS. 7 and 8, for example, in addition to those described above. FIG. 7 is a front view, and FIG. 8 is a perspective view of a main section of FIG. 7. A permanent magnet 27 shown in FIGS. 7 and 8 is fixed to the surface facing the movable iron core 8, of a crossing iron core 28 mounted on the fixed iron core 7. That is, the permanent magnet 27 is fixed to the back side of the crossing iron core 28 in the drawing, and both end sides of the crossing iron core 28 are fixed to the permanent magnet fixing portions 7*c* of the fixed iron core 7 by bolting or the like. Also in such a configuration, the electromagnetic device can realize the same effects as those in the electromagnetic device shown in FIG. 1.

Next, other operations and effects in the configuration of the electromagnetic device of this embodiment will be described.

The distance between the movable contact 2 and the fixed contact 1 at the time of the opening of the vacuum valve 3 varies according to the rated voltage of the switching device. In general, if the rated voltage is lowered, the distance between the contacts is shortened. An operation force of the movable contact may also be small.

In the electromagnetic device 4 of this embodiment, the amount of displacement of the movable iron core 8, that is, the distance from the advanced position to the retreated position of the movable iron core 8 can be easily shortened only by shortening the length of the supporting post 12. Further, an operation force which is generated by the electromagnetic device 4 can be reduced only by reducing the number of lamination layers of the movable iron core 8 and the fixed iron core 7. The shapes of the thin plates configuring each iron core may be the same, and therefore, adjustment of an electromagnetic force can be easily performed.

In a case where the thin plates configuring the fixed iron core 7 and the movable iron core 8 of the electromagnetic device 4 are manufactured by press working, it is necessary to prepare a mold for a press. However, an initial investment is required for the making of the mold. Preparing individually the molds according to the working voltage of the switching device requires an initial investment with respect to the respective molds, and thus, is inefficient. By adopting the configuration of the invention of this application, the shapes of the thin plates configuring the fixed iron core and the movable iron core can be made constant regardless of the rated voltage of the switching device. In this manner, it is possible to easily deal with each rated voltage by a change in the number of lamination layers and a change in the length of the supporting post, and therefore, in the manufacture of the electromagnetic device, an initial investment amount can be reduced and further cost reduction due to a mass production effect becomes possible.

As described above, according to the electromagnetic device of Embodiment 1, the electromagnetic device has the fixed iron core, the movable iron core which is disposed to face the fixed iron core with the drive shaft fixed to the central portion and is displaceable in the axis line direction of the drive shaft between the retreated position away from the fixed iron core and the advanced position coming close to the fixed iron core, the electromagnetic coil provided in the fixed iron core, the permanent magnet which retains the movable iron core at the advanced position, the plurality of supporting posts which are provided parallel to the axis line direction on both side surfaces of the fixed iron core and support the fixed iron core, the opening-side plate which is provided at one end portion on the movable iron core side in the longitudinal direction of the supporting post and in which the drive shaft passes therethrough and is supported, and the closing-side plate which is provided at the other end portion in the longitudinal direction of the supporting post and in which the drive shaft passes therethrough and is supported, and is configured such that the advanced position of the movable iron core is restricted by the fixed iron core and the retreated position is restricted by the opening-side plate. Therefore, the drive shaft of the movable iron core supported by both plates is reliably restricted by the closing-side plate and the opening-side plate, and it is possible to prevent tilting occurring between the fixed iron core and the movable iron core, and therefore, occurrence of a gap between the fixed iron core and the movable iron core, which occurs when the movable iron core is at the advanced position, can be prevented. Therefore, since a retention force generated by the permanent magnet is stable, it becomes possible to reduce the volumes of the permanent magnet, the fixed iron core, and the movable iron core, which are required in order to generate a predetermined retention force, and thus, it is possible to attain a reduction in size and a reduction in cost of the electromagnetic device.

Further, each of the opening-side plate and the closing-side plate has the bearing mounting hole in which the bearing for the drive shaft passing therethrough is mounted, and the supporting post mounting holes, in each of which the supporting post is mounted, the fixed iron core is configured by laminating thin plates, the supporting post mounting hole for the supporting post which is mounted on the surface on one side in the lamination layer direction of the fixed iron core, among the plurality of supporting posts supporting the fixed iron core, is formed to be positioned in a predetermined dimension on the basis of the bearing mounting hole, and the supporting post mounting hole for the supporting post which is mounted on the surface on the other side is formed to have a size in which the supporting post can be mounted even if a mounting position is varied within a dimensional tolerance of the thickness in the lamination layer direction of the fixed iron core. Therefore, even if variation due to a dimensional tolerance of the thin plate of each of the fixed iron core and the movable iron core is present in a thickness dimension, processes of lamination layer number adjustment work and position adjustment work become unnecessary, and thus assembling becomes easy.

Further, the respective width dimensions in the same direction as the lamination layer direction, of the fixed iron core, the movable iron core, and the permanent magnet, are formed to be large in the order of the permanent magnet, the movable iron core, and the fixed iron core. Therefore, magnetic flux which is generated by the permanent magnet efficiently passes through the fixed iron core and the movable iron core, and thus, a retention force which is generated by the permanent magnet can be used with high efficiency.

In addition, according to the switching device related to Embodiment 1, the switching device includes the switch main body section having the fixed contact and the movable contact capable of coming into contact with and being separated from the fixed contact, the electromagnetic device which is connected to the movable contact of the switch main body section through the connecting device and makes the movable contact come into contact with and be separated from the fixed contact, and the biasing body which biases the movable iron core of the electromagnetic device in a direction in which the movable contact is separated from the fixed contact, wherein as the electromagnetic device, the electromagnetic device described is used. Therefore, occurrence of variation in tilting of the facing surfaces of the movable iron core and the fixed iron core of the electromagnetic device is suppressed, and thus variation in the attraction force of the permanent magnet can be reduced. Additionally, variation in switching operation is suppressed, and thus, it is possible to obtain a switching device having excellent operation characteristics.

Embodiment 2

Figure 9:
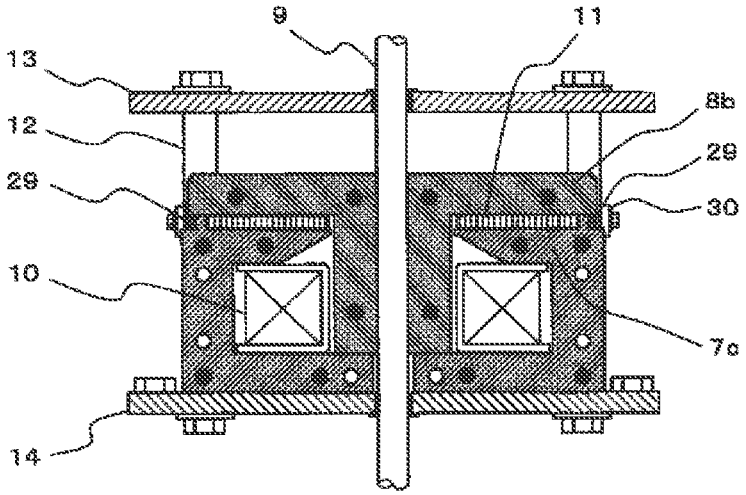
[FIG. 9]
Figure 10:
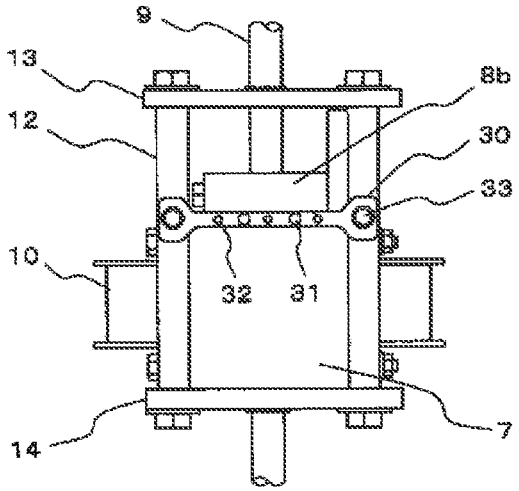
[FIG. 10]
Figure 11:
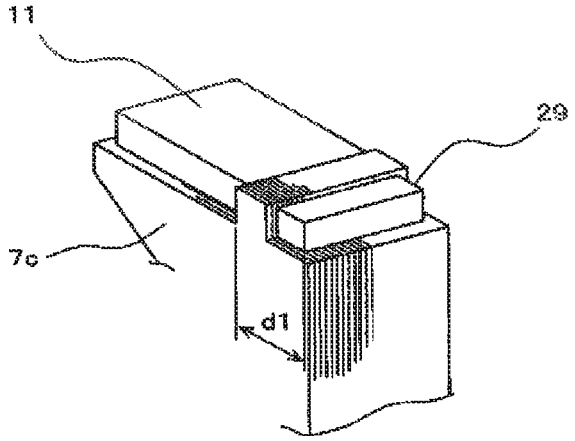
[FIG. 11]

FIG. 9 is a cross-sectional front view of an electromagnetic device according to Embodiment 2, and FIG. 10 is a side view thereof. Further, FIG. 11 is a perspective view of a main section of FIG. 9. The configuration of a switching device using the electromagnetic device is the same as that in Embodiment 1, and therefore, illustration and description are omitted, and in the following, description will be made to Locus on differences.

In an electromagnetic device, there is a case where adjustment of an attraction and retention force which is generated by a permanent magnet is performed in a fixed iron core section according to a rating. In order to suppress an initial investment, with respect to a fixed iron core, it is preferable to unify the shapes of the thin plates configuring the fixed iron core in a plurality of ratings, as also described in Embodiment 1.

As a configuration to perform the adjustment of the attraction and retention force in a state where the shapes of the thin plates are unified, for example, there is a method in which a magnetic member having a size corresponding to a rating is directly mounted on a fixed iron core. However, in a configuration in which a magnetic member is mounted on a portion of the laminated fixed iron core, a measure such as providing a mounting hole in the thin plate of the fixed iron core and then performing fixing is required, and thus there is a problem in that a fixing method becomes complicated.

Therefore, in the electromagnetic device of this embodiment, as shown in FIGS. 9 to 11, a retention force adjusting member 29 made of a magnetic body is disposed on the fixed iron core 7 on the side close to the supporting post 12 between the permanent magnet fixing portion 7*c* of the fixed iron core 7 and the branch portion 8*b* of the movable iron core 8. The retention force adjusting member 29 is mounted on a supporting member 30 by a bolt 31, a pin 32, or the like, and both ends of the supporting member 30 are fixed to the supporting posts 12 by bolts 33. In the perspective view of FIG. 11, the supporting member 30 is omitted for easily understanding of the shape of the retention force adjusting member 29.

In addition, an external appearance in a case where the retention force adjusting member 29 is not mounted is as shown in FIGS. 3 and 4 of Embodiment 1.

Figure 12A:
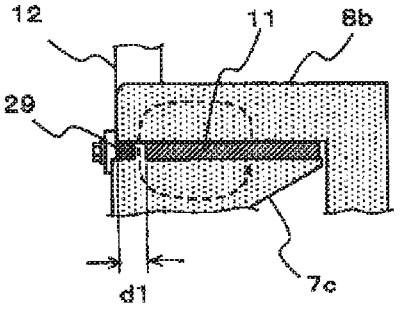
FIGS. 12A, 12B are an explanatory diagram describing an operation of the electromagnetic device of Embodiment 2.
Figure 12B:
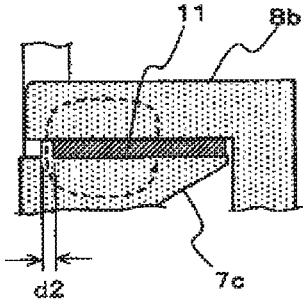

Here, an operation of the retention force adjusting member 29 will be described with reference to FIG. 12. FIG. 12A is an enlarged view of a peripheral portion of the retention force adjusting member 29, and FIG. 12B shows the same portion in a case where there is no retention force adjusting member 29, as a comparative example.

In FIG. 12A, the magnetic flux emitted from the permanent magnet 11 passes through a pathway as shown by a broken line in the drawing. At this time, in a case where there is the retention force adjusting member 29, since the retention force adjusting member 29 is a magnetic body, a width d1 of the pathway of the magnetic flux is increased by an amount corresponding to the retention force adjusting member 29. On the other hand, in a case where there is no retention force adjusting member 29, as shown in FIG. 12B, the pathway of the magnetic flux has a width of d2, and thus, becomes smaller than d1 in FIG. 12A.

In addition, load F which is generated by the magnetic force of a permanent magnet is proportional to $B^2 \cdot S$ (B: magnetic flux density, S: area through which magnetic flux passes), that is, the product of the square of magnetic flux density and an area through which magnetic flux passes. In this embodiment, in a site where the retention force adjusting member 29 is installed, both the widths d1 and d2 of the pathway through which magnetic flux passes are used as an area of saturated magnetic flux. In the area of saturated magnetic flux, the value of the magnetic flux density B hardly changes, and therefore, the load F (a retention force) changes approximately in proportion to the area S (the width of d1 or d2) through which magnetic flux passes. In this embodiment, the retention force adjusting member 29 is mounted with a relationship of d1>d2, whereby a retention force becomes stronger.

However, in a case where design conditions are different, another phenomenon occurs. In a case where the width of the pathway through which magnetic flux passes is used as an area where magnetic flux is not saturated, magnetic flux $\phi$ which is generated by a permanent magnet is substantially constant, and a relationship of $\phi = B \cdot S$ (B: magnetic flux density, S: area through which magnetic flux passes) is established. The load F which is generated by the magnetic force of the permanent magnet has a relationship of $\phi^2/S$ if B of $B^2 \cdot S$ is replaced by $\phi$. That is, if an area through which magnetic flux passes increases, the load F decreases, and thus a retention force becomes weak.

As described above, the effect of the retention force adjusting member 29 changes according to design conditions.

In this manner, in the configuration of the present invention, by mounting the retention force adjusting member 29 on the supporting member 30 and fixing the supporting member 30 to the supporting posts 12, it is possible to easily adjust the width of the pathway of magnetic flux, and therefore, the retention force adjustment of the electromagnetic device 4 can be easily realized.

Further, by preparing a plurality of retention force adjusting members having different shapes, and then changing the shape, it becomes possible to easily perform fine adjustment of a retention force.

As described above, according to the electromagnetic device of Embodiment 2, the retention force adjusting member adjusting the retention force of the permanent magnet is disposed in the vicinity of the permanent magnet and the retention force adjusting member is mounted on the supporting posts through the supporting member, and therefore, in addition to the effects in Embodiment 1, the retention force adjustment of the electromagnetic device can be easily realized, and thus an electromagnetic device having a retention force adapted to the rating of a switch that is an operation target can be easily provided.

Embodiment 3

Figure 13:
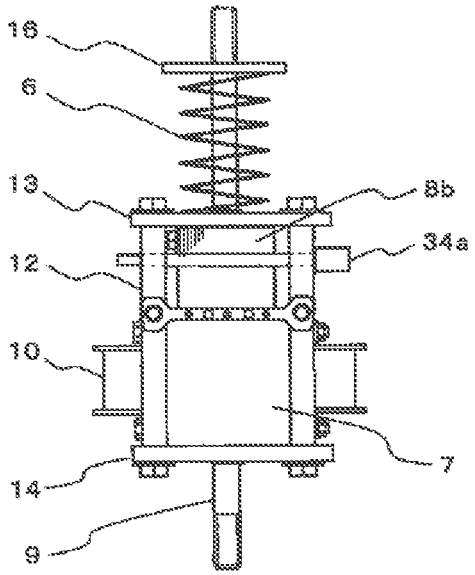
[FIG. 13]

FIG. 13 is a side view of an electromagnetic device according to Embodiment 3. The configuration of a switching device using the electromagnetic device is the same as that in Embodiment 1. Portions equivalent to those in Embodiment 1 or 2 are denoted by the same reference numerals and the redundant description thereof is omitted. In the following, description will be made to focus on portions of differences.

In an operating device of the switching device, closing prevention means or opening prevention means is required at the time of a periodic check, or the like. Therefore, the electromagnetic device of this embodiment is provided with the prevention means.

In FIG. 13, the electromagnetic device has a configuration having a closing prevention pin 34*a* as the closing prevention means. In the drawing, the movable iron core 8 is at an opening position. A pin hole is formed in the supporting post 12 so as to be able to dispose the closing prevention pin 34*a* at a position on the closing side with respect to the branch portion 8*b* of the movable iron core 8. At the time of a periodic check, or the like, in a case where the movable iron core 8 is retained and locked at the opening Position, closing prevention can be performed only by manually inserting the closing prevention pin 34*a* to pass through the two supporting posts 12 in the lamination layer direction of the movable iron core 8, and therefore, it is not necessary to separately prepare a structural body for closing prevention in addition to the closing prevention pin 34*a*, and thus a closing prevention structure can be realized at low cost.

Figure 14:
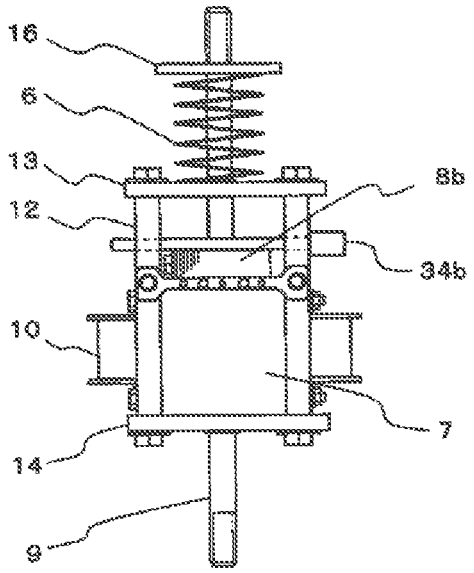
[FIG. 14]

FIG. 14 is a side view showing an example which is a modified example of FIG. 13 and has basically the same configuration as that in FIG. 13 except that an opening prevention pin 34*b* that is the opening prevention means is provided by adjusting the position of the closing prevention pin 34*a* that is the closing prevention means. The shape of the pin itself is the same as that of the closing prevention pin 34*a*. Here, the movable iron core 8 is at a closing position, and a configuration is made such that opening is prevented by forming a pin hole in the supporting post 12 such that at this position, the upper surfaces of the branch portions 8*b* of the movable iron core 8 come into contact with the opening prevention pin 34*b*.

Figure 15:
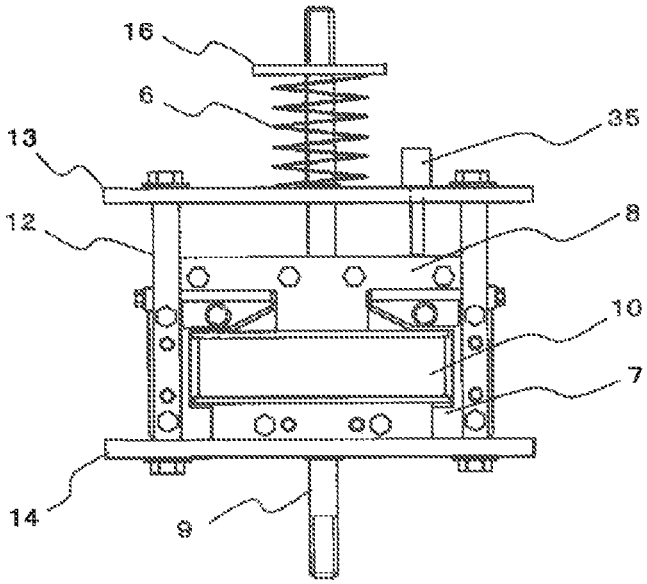
[FIG. 15]

FIG. 15 is another example of the opening prevention means and shows a configuration having an opening prevention pin 35 as the opening prevention means. In the drawing, the movable iron core 8 is at the closing position. In order to prevent the movement in an opening direction of the movable iron core 8, a structure is made in which a threaded hole is provided in the opening-side plate 13 and the opening prevention pin 35 is manually screwed in the opening-side plate 13, thereby pressing down the surface on the opening side of the movable iron core 8. Due to such a structure, it is not necessary to separately prepare a structural body for opening prevention in addition to the opening prevention pin 35, and thus an opening prevention structure can be realized at low cost.

Further, in a switching device using an electromagnetic device, the switching device needs to be provided with an auxiliary contact for identifying the opening and closing of a contact section, a turn-on-and-off display for displaying the opening and closing of the contact section, a counter displaying the number of times of switching operations, or the like. However, if these devices are mounted on an electromagnetic device of a switch, there is the advantage that the handling of components at the time of assembling becomes easy.

Figure 16:
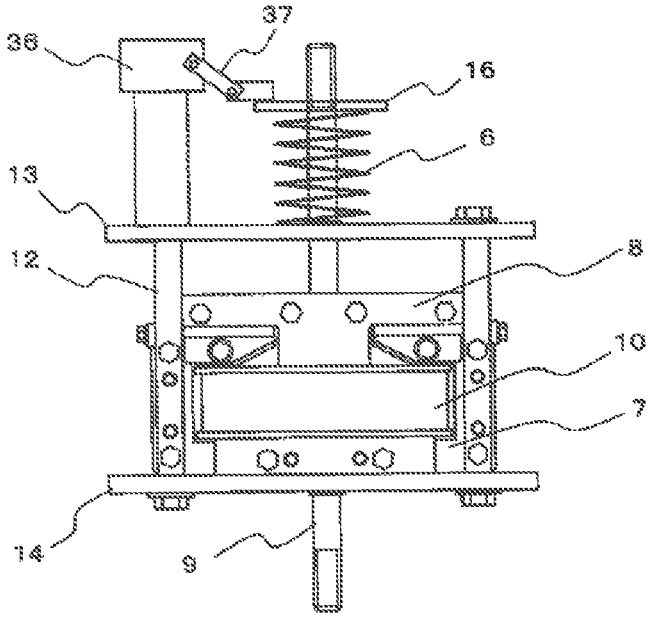
[FIG. 16]

FIG. 16 shows a structure in which, in the electromagnetic device according to the present invention, an auxiliary contact 36 is mounted on the opening-side plate 13. A connection mechanism 37 is mounted on the spring bearer 16 side of the opening spring 6, and thus a configuration is made such that if the position of the movable iron core 8 is switched between the advanced position and the retreated position, the auxiliary contact 36 is switched. Illustration of the closing prevention pin 34*a* or the opening prevention pin 34*b* or 35 described above is omitted. However, a configuration can be made likewise. In the electromagnetic device 4 of this application, since the configuration can be made by easily mounting the components on the electromagnetic device 4 which is an operating section of the switching device, it is possible to unitize and assemble the electromagnetic device as an operating device, and thus it is possible to improve the efficiency of a production line.

REFERENCE SIGNS LIST

1: fixed contact
2: movable contact
3: vacuum valve (switch main body section)
3*a*: insulation container
3*b*: movable electrode rod
4: electromagnetic device
5: connecting device
6: opening spring (biasing body)
7: fixed iron core
7*a*: transverse iron core portion
7*b*: longitudinal iron core portion
7*c*: permanent magnet fixing portion
7*d*: opening hole
8: movable iron core
8*a*: mainstay portion
8*b*: branch portion
9: drive shaft
10: electromagnetic coil
11, 27: permanent magnet
12: supporting post
12*a*: threaded hole
13: opening-side plate
14: closing-side plate
14*a*: bearing mounting hole
14*b*, 14*c*: supporting post mounting hole
15*a*, 15*b*: bearing
16: spring bearer
17, 32: pin
18, 31, 33: bolt
19: supporting member
20: mounting post
21: insulating rod
21*a*: connecting rod
22: pressure-contacting device
23: bellows
24: spring frame
25: fall-off preventing plate
26: pressure-contacting spring
28: crossing iron core
29: retention force adjusting member
30: supporting member
34*a*: closing prevention pin
34*b*, 35: opening prevention pin
36: auxiliary contact
37: connection mechanism

The invention claimed is:

1. An electromagnetic device comprising:

a fixed iron core;

a movable iron core which is disposed to face the fixed iron core with a drive shaft fixed to a central portion and is displaceable in an axis line direction of the drive shaft between a retreated position away from the fixed iron core and an advanced position coming close to the fixed iron core;

an electromagnetic coil provided in the fixed iron core;

a permanent magnet which retains the movable iron core at the advanced position;

a plurality of supporting posts which are provided parallel to the axis line direction on both side surfaces of the fixed iron core and support the fixed iron core;

an opening-side plate which is provided at one end portion of the supporting post on the movable iron core side in a longitudinal direction and in which the drive shaft passes therethrough and is supported; and a closing-side plate which is provided at the other end portion of the supporting post in the longitudinal direction and in which the drive shaft passes therethrough and is supported, wherein the advanced position of the movable iron core is restricted by the fixed iron core, and the retreated position is restricted by the opening-side plate, wherein each of the opening-side plate and the closing-side plate has a bearing mounting hole in which a bearing for the drive shaft passing therethrough is mounted, and supporting post mounting holes, in each of which the supporting post is mounted, the fixed iron core is configured by laminating thin plates, and the supporting post mounting hole for the supporting post which is mounted on a surface on one side of the fixed iron core in a lamination layer direction, among the plurality of supporting posts supporting the fixed iron core, is formed to be positioned in a predetermined dimension on the basis of the bearing mounting hole, and the supporting post mounting hole for the supporting post which is mounted on a surface on the other side is formed to have a size in which the supporting post can be mounted even if a mounting position is varied within a dimensional tolerance of a thickness in the lamination layer direction of the fixed iron core.

2. The electromagnetic device according to claim 1, wherein the respective width dimensions of the fixed iron core, the movable iron core, and the permanent magnet in the same direction as the lamination layer direction are formed to be large in the order of the permanent magnet, the movable iron core, and the fixed iron core.

3. The electromagnetic device according to claim 1, wherein a retention force adjusting member which adjusts a retention force of the permanent magnet is disposed in the vicinity of the permanent magnet, and the retention force adjusting member is mounted on the supporting posts through a supporting member.

4. A switching device comprising:

a switch main body section having a fixed contact and a movable contact capable of coming into contact with and being separated from the fixed contact;

an electromagnetic device which is connected to the movable contact of the switch main body section through a connecting device and makes the movable contact come into contact with and be separated from the fixed contact; and a biasing body which biases a movable iron core of the electromagnetic device in a direction in which the movable contact is separated from the fixed contact, wherein as the electromagnetic device, the electromagnetic device according to claim 1 is used.

* * * * *